United States Patent [19]

Lindahl

[11] Patent Number: 4,599,138

[45] Date of Patent: Jul. 8, 1986

[54] PROCESS FOR PRETREATING PARTICULATE LIGNOCELLULOSIC MATERIAL TO REMOVE HEAVY METALS

[75] Inventor: Jonas A. I. Lindahl, Domsjo, Sweden

[73] Assignee: Mooch Domsjo Aktiebolag, Ornskoldsvik, Sweden

[21] Appl. No.: 316,461

[22] Filed: Oct. 30, 1981

Related U.S. Application Data

[63] Continuation-in-part of Ser. No. 98,278, Nov. 28, 1979, abandoned, which is a continuation of Ser. No. 901,935, May 1, 1978, abandoned.

[30] Foreign Application Priority Data

May 2, 1977 [SE] Sweden ..... 77050730

[51] Int. Cl.[4] ..... D21C 1/04; D21C 3/26

[52] U.S. Cl. ..... 162/19; 162/25; 162/26; 162/28; 162/65; 162/78; 162/84; 162/86

[58] Field of Search ..... 162/18, 56, 23, 24, 162/25, 26, 19, 65, 78, 90, 20, 37, 40, 41, 261, 28, 84, 86

[56] References Cited

U.S. PATENT DOCUMENTS

| | | | |
|---|---|---|---|
| 2,717,195 | 9/1955 | Armstrong | 162/24 |
| 3,023,140 | 2/1942 | Textor | 162/26 |
| 3,467,574 | 9/1969 | West | 162/24 |
| 3,578,554 | 5/1971 | Richter | 162/19 |
| 3,811,993 | 5/1974 | Ghisoni | 162/56 |
| 4,029,543 | 6/1977 | Lindahl | 162/24 |
| 4,050,981 | 9/1977 | Jamicson et al. | 162/37 |
| 4,052,280 | 8/1977 | Mackie | 162/79 |
| 4,152,197 | 5/1979 | Lindahl et al. | 162/19 |
| 4,187,141 | 2/1980 | Ahrel | 162/26 |

FOREIGN PATENT DOCUMENTS

| | | | |
|---|---|---|---|
| 2439077 | 3/1975 | Fed. Rep. of Germany | 162/19 |
| 2818320 | 11/1978 | Fed. Rep. of Germany | 162/25 |
| 208983 | 11/1966 | Sweden . | |

OTHER PUBLICATIONS

Continuous Pulping Processes; Rydholm; *TAPPI,* Publication Stap No. 7, 1970.

Kamyr, Pulp Equipment, Kamyr AB, Feb. 1972.

Refiner Mechanical Pulping, Defibrator AB.

*Primary Examiner*—Steve Alvo

[57] ABSTRACT

A process is provided for pretreating particulate lignocellulosic material to remove heavy metals and resin without any delignification or defibration, which comprises washing particulate lignocellulosic material; compressing the washed material to a solids content of at least 40% to remove absorbed and excess liquid; impregnating the compressed material with an alkaline aqueous solution comprising alkali and at least one of a heavy metal ion complexing agent and a heavy metal ion reducing agent; heating the impregnated material at a temperature within the range from abut 50° to 100° C. for up to approximately 0.75 hour; compressing the pretreated material to a solids content of at least 40%; and separating undiluted liquor squeezed out during the compression, while maintaining conditions during the pretreating such that the pH of the squeezed-out liquor is within the range from about 4 to about 9.5; thereby separating heavy metal ions, resins and alkali-extracted substances in solution in the expressed liquor, but not any lignin.

19 Claims, 2 Drawing Figures

PROCESS FOR PRETREATING PARTICULATE LIGNOCELLULOSIC MATERIAL TO REMOVE HEAVY METALS

This application is a continuation-in-part of Ser. No. 98,278, filed Nov. 28, 1979, which in turn is a continuation of Ser. No. 901,935, filed May 1, 1978, both now abandoned.

In the pulping and defibration of particulate lignocellulosic material such as wood chips to reduce the material to cellulose pulp, using either chemical or mechanical pulping techniques, or a mixture of both, heavy metals such as iron, manganese and copper interfere by catalyzing the degradation of the lignocellulosic material, reducing brightness and strength, and the decomposition of certain treating chemicals such as peroxide bleaching agents. The effect on color in part results from the formation of dark-colored complexes of the heavy metal ions with lignin and lignin derivatives in the wood. The catalytic effect is enhanced at the elevated temperatures needed or occurring during the delignification, defibration and refining of wood.

Many efforts have been made to alleviate the deleterious effect of heavy metal ions and compounds. Metal chelating agents such as diethylene triamine pentaacetic acid, ethylene diamine tetraacetic acid, nitrilotriacetic acid, and their salts; magnesium chemicals; and chelating phosphate compounds have been added either to the pulping liquor or in a pretreatment of the lignocellulosic material. Such complexing agents tie up the heavy metal ions in aqueous solution in slightly ionized complexes, which can accordingly be separated from the water-insoluble lignocellulosic material.

Thus, for example, U.S. Pat. No. 3,023,140 to C. K. Textor patented Feb. 27, 1962, proposes a method for producing wood chip refiner pulp in several steps, complexing agents and peroxide bleaching agents being added in one or more of the refining steps.

U.S. Pat. No. 3,701,712 to Samuelson and Noreus, patented Oct. 31, 1972, provides a process for treating lignocellulose materials with alkali in the presence of oxygen and in the presence of a complex magnesium salt of an amino polycarboxylic acid or alkali metal salt thereof. Before carrying out the oxygen/alkali digestion process of the invention, Samuelson and Noreus suggest that it is suitable to pretreat the wood with an aqueous solution containing sulfur dioxide or a sulfite, and, to produce a pulp which is metal-free, to carry out the pretreatment in the presence of a complexing agent for bivalent and/or polyvalent metal ions such as copper, iron, manganese, cobalt and vanadium. Such chelating agents include the chelating salts of nitrogen-containing polycarboxylic acids, polyphosphates, and ethylenediamine and ethylenediamine derivatives. The wood can be washed with water between the pretreatment and the oxygen/alkali digestion, but it is indicated that omission of the washing is usually disadvantageous.

Samuelson and Noreus, U.S. Pat. No. 3,769,152, patented Oct. 30, 1973, describe a process for the production of cellulose pulp of high brightness from wood by digestion with alkali and oxygen in aqueous solution under moderate oxygen pressure, limiting the amount of alkali at the start of the digestion to less than that required, and progressively adding alkali as the digestion continues, while maintaining the digestion liquor at a pH within the range from about 9.2 to about 13. It is also indicated that it is particularly advantageous to pretreat the wood before the digestion with water or an aqueous acidic, neutral, or alkaline solution, preferably in several stages, and preferably at an elevated temperature within the range from about 30° to about 150° C. Sulfur dioxide or a sulfite can be present, as well as a complexing agent for bivalent and/or polyvalent metal ions, and the wood can be washed with water between the pretreatment stage and the oxygen digestion stage, although omission of the washing is indicated to usually be disadvantageous.

Jamieson, Samuelson, Smedman and Sondell, U.S. Pat. No. 4,050,981, patented Sept. 27, 1977, describe a process for improving the selectivity of delignification of lignocellulosic material in the presence of oxygen gas and alkali by maintaining a carbon monoxide content in the gas phase within the range from about 1% to about 12% by volume. Prior to the delignification process of the invention, the lignocellulosic material optionally but preferably is subjected to a pretreatment with water and/or an aqueous solution in one or more stages, to remove metal ions or compounds such as copper, cobalt, iron and manganese, by dissolution in the pretreating liquor. The pretreatment can be with an acid or alkaline liquor at an elevated temperature, and a chelating or complexing agent for the metal ions can also be present. Jamieson et al indicate that a washing of the lignocellulosic material after pretreatment and prior to the delignification process of the invention is desirable.

The difficulty with these processes is that very dilute solutions of complexing agents are obtained as waste liquors, which are difficult to recycle, and difficult as well as expensive to purify before being run off to waste.

U.S. Pat. No. 4,152,197 patented May 1, 1979 to Lindahl et al., provides process and apparatus for the preparation of improved high-yield cellulose pulps, such as semichemical, chemimechanical, thermomechanical, and mechanical pulps, which comprises mechanically defibrating a mixture of particulate lignocellulosic materials which have been partially pulped and softened to different extents. Part of the raw lignocellulosic material in particulate form is washed, moistened with steam, impregnated with pulping chemicals and pulped to a yield of from about 65 to about 92%. Another part is treated in similar manner but either not pulped at all or, if pulped, pulped to a lesser extent. The two parts are mixed without intermediate washing, after which the mixture is subjected to a vapor phase pulping by heating to a temperature within the range from about 90° to about 200° C., under pressure to obtain softening of the lignin, and delignification, after which the resulting product is mechanically defibrated to form cellulose pulp.

In this process, lignin is of course removed in each pulping stage.

When the chip stream A is pulped or delignified in the digester 6, Lindahl et al obtained a pulp yield of from about 65 to about 92%, and preferably about 78 to about 88%. This demonstrates that delignification has taken place.

In each of Examples 1, 2, 3, 4 and 5 of Lindahl et al, the digestion in the digester 6 is carried out at a temperature of 170° C. Note column 7, line 41; column 8, line 66; column 10, line 23; column 11, line 50; and column 13, line 13.

Lindahl et al does not suggest weakening the processing conditions for stream A, so as to avoid any delignification and instead obtain simply extraction of heavy metal ions, resins, and alkali-extractable substances using an alkaline liquor. In each of the working Examples where stream A is described, the digestion is carried out on the acid side, with an acid pulping liquor at a pH of 6. Note column 7, line 36; column 8, line 61; column 10, line 18; column 11, line 45; column 13, line 8; column 15, line 44; and column 16, line 56. Under such conditions using an acidic pulping liquor, the alkali-extractable substances would certainly not be removed. While at column 4, lines 24 and 25 Lindahl et al do disclose the use of alkaline pulping solutions, they disclose use of such solutions not for the extraction of heavy metal ions, resins and alkali-extractable substances but only for delignification.

In accordance with the process of this invention, particulate lignocellulosic material is pretreated to remove heavy metals and resins without any delignification and/or defibration, which comprises washing particulate lignocellulosic material; compressing the washed material to a solids content of at least 40% to remove undiluted, absorbed liquid; impregnating the compressed material with an alkaline aqueous solution comprising alkali and at least one member selected from the group consisting of a heavy metal ion complexing agent and a heavy metal ion reducing agent; heating the impregnated material at a temperature within the range from about 50° to 100° C. for up to approximately 0.75 hour; compressing the pretreated material to a solids content of at least 40%; and separating undiluted liquor squeezed out during the compression while maintaining conditions during the pretreating such that the pH of the squeezed-out liquor is within the range from about 4 to about 9.5, thereby separating heavy metal ions, resins and alkali-extracted substances in solution in the expressed liquor but not lignin.

Following the pretreatment the particulate lignocellulosic material can be delignified and pulped and/or defibrated by either chemical or mechanical or combined chemical and mechanical delignifying, pulping and defibrating processes.

It is especially advantageous in carrying out the process of the invention to control the amount of alkali in the pretreating solution so that the pH of the expressed undiluted and separated pretreating liquor at the conclusion of the pretreatment is within the range from about 4 to about 9.5, and preferably from about 5 to about 7.5. The amount of complexing agent in the pretreating solution should be within the range from 0.05% to about 0.80%, based on the dry weight of the particulate lignocellulosic material.

It is also especially advantageous to have present in the pretreating liquor a reducing agent for heavy metal ions, such as sulfur dioxide, sulfurous acid or a sulfite salt. The amount of reducing agent is within the range from about 0.1% to about 3.0%, based on the dry weight of the particulate lignocellulosic material.

After impregnation with the pretreating liquor, the particulate lignocellulosic material is heated in a closed vessel at a temperature of at least about 50° C. up to at most 100° C. for a time from about 6 to about 45 minutes. At the conclusion of the pretreating time, the hot particulate lignocellulosic material is subjected to compression to a solids content of at least 40%, while the pretreating liquor that is thus expressed is continuously removed. The expressed undiluted liquor contains heavy metal ions, resins, and other alkali-soluble substances, extracted from the wood and bound in soluble complex form in the pretreating liquor. No free sulfur dioxide is present, if the amount of sulfur dioxide added is optimized in accordance with the invention, and no lignin, since the mild treating conditions do not lead to extraction of lignin.

After compression to a solids content of at least about 40%, the lignocellulosic material can be digested and thereby partially chemically pulped by heating in a pressure vessel such as a digester with steam and/or compressed air at a temperature within the range from about 90° to about 180° C. for from about 1 to about 15 minutes, preferably from about 2 to about 5 minutes, and is then subjected to mechanical defibration such as by refining in a disc refiner or in a screw defibrator of the type sold under the tradename FROTAPULPER. If compressed air is used for pressurizing the vessel, the defibration can be carried out at a lower temperature than is possible when steam is used.

Alternatively, the particulate lignocellulosic material compressed to a solids content of at least 40% can be defibrated directly, without first being heated under pressure.

After the chips have been compressed to a solids content of at least 40%, and the expressed undiluted pretreating liquor removed, the lignocellulosic material also can be chemically pulped using any chemical digestion or pulping process, and a suitable aqueous pulping liquor, such as (for example) an acidic sulfite liquor, a bisulfite liquor, or a sulfite liquor, or an alkaline liquor such as sodium hydroxide, sodium carbonate, sodium bicarbonate, or white liquor for sulfate pulping, or sodium hydroxide for oxygen/gas delignification.

In a further preferred embodiment of the invention, the pretreated lignocellulosic material after treatment with steam and/or compressed air at a temperature within the range from about 90° to about 180° C. under a pressure within the range from about 0.05 to about 1 MPa is bleached simultaneously with defibration in a disc refiner. The bleaching agent is supplied to the disc refiner so that it is mixed with the lignocellulosic material in the vicinity of the circumference of the grinding disc, and in a distance of at least one third of the disc radius from its center. Any bleaching agent can be used, particularly a lignin preserving bleaching agent such as a peroxide. It is especially suitable to use a peroxide together with conventional peroxide bleaching agent adjuncts, such as, for example, a mixture of hydrogen peroxide with sodium hydroxide, sodium silicate and magnesium sulfate. When sodium silicate is used, it is especially suitable to apply this separately at the circumference of the grinding discs or at a distance of at most 200 mm from their circumference, and to supply the remaining bleaching agent to the center of the grinding discs, or at a distance from the center corresponding to at most one quarter of the grinding disc radius. The formation of a hard silicate coating on the surface of the grinding discs can thus be inhibited.

A particular advantage of the process of the invention is that the volume of undiluted waste liquor containing the heavy metal ion complexes and alkali-soluble extracted materials is substantially reduced which means that smaller volumes of liquor have to be handled and discarded or processed for recovery of their chemicals content. This reduces operating costs, and also facilitates waste liquor disposal.

A further advantage noted in the bleaching of mechanical and chemimechanical pulp is the combination of bleaching with defibration, which means that there is no need for a bleaching section in the pulping plant.

The process of the present invention also makes possible the production of a bright and strong pulp at a lower energy consumption than has been possible heretofore, using mechanical or chemimechanical pulping techniques. The pulp furthermore has a good processability, and is well suited for paper production, giving good dewatering, good sheet formation, and good surface uniformity. It is quite surprising, taking into account the experience of the prior art, to obtain such a high brightness and strength at such a low energy consumption, utilizing the process of the invention.

The process of the invention can be applied to any kind of lignocellulosic material, but is especially applicable to wood. Both hardwood and softwood can be pulped satisfactorily using this process. Exemplary hardwoods which can be pulped include birch, beech, poplar, cherry, sycamore, hickory, ash, oak, chestnut, aspen, maple, alder and eucalyptus. Exemplary softwoods include spruce, fir, pine, cedar, juniper and hemlock.

The lignocellulosic material should be in particulate form. Wood chips having dimensions that are conventionally employed in pulping processes can be used. The wood can be in the form of nonuniform fragments of the type of wood shavings or chips having an average thickness of at most 3 mm, and preferably within the range from about 0.2 to about 2 mm. Sawdust, wood flour, wood slivers and splinters, wood granules, and wood chunks, and other types of wood fragments can also be used.

The washing of the raw material is carried out under conditions such that impurities are flushed away or removed by dissolution in the water.

It is frequently possible to remove most of the particulate as well as the water-soluble impurities by washing the lignocellulosic material with water. An improved dissolution is obtained at elevated temperatures.

A suitable washing treatment is carried out using hot water at a temperature within the range from about 60° to about 130° C. for from 0.1 to about 10 minutes. In the course of the heat treatment in the presence of water, some of the lignocellulosic material is hydrolyzed to give organic acids which dissolve in the solution, for example acetic acid, and the resulting acid solution has an improved capacity for dissolution of metal ions or compounds present in the lignocellulosic material. Moreover the wood structure is softened.

Aqueous acidic solutions containing organic and inorganic acids can also be used for the washing, such as acetic acid, citric acid, formic acid, oxalic acid, hydrochloric acid, sulphurous acid, sulphuric acid, nitric acid, phosphoric acid and phosphorous acid. Such solutions can have a pH within the range from about 1 to about 5, suitably from about 1.5 to about 4, and preferably from about 2 to about 3.5, with the contact continued for from about 0.1 to about 10 minutes. Treatment with acidic aqueous solutions can be carried out at ambient temperatures, i.e., from about 10° to about 30° C., but elevated temperatures can also be used, ranging from about 40° to about 100° C. In the case of raw lignocellulosic materials, such as wood, such a treatment may be accompanied by hydrolysis of the cellulose, with the formation of additional acids.

However, when the delignification process of the invention is applied to paper pulp, it is usually desirable to avoid hydrolysis of the cellulose. In such cases, the time and temperature of the treatment together with the pH should be adjusted so that depolymerization of the carbohydrate material in the pulp is kept to a minimum.

For the impregnation an aqueous alkaline solution is suitably used, such as an alkali metal hydroxide or alkali metal carbonate or bicarbonate solution, for example, sodium hydroxide, sodium carbonate and sodium bicarbonate solution, the alkaline hydroxides or salts being used singly or in admixture. The impregnation usually takes place instantaneously and is at all events performed in less than 10 minutes.

The alkaline treatment is carried out at an elevated temperature within the range from about 50° to about 100° C., preferably from about 70° to about 90° C., until there has been dissolved in the solution an amount of organic material within the range from about 1 to about 8% by weight, suitably from about 1.5 to about 6% by weight, and preferably from about 2 to about 4% by weight, based on the dry weight of the lignocellulosic material, but no lignin. The treatment time can be within the range from about 0.1 to about 0.75 hour, preferably from about 0.1 to about 0.5 hour.

Chelating or complexing agents for the heavy metal ions to be removed are also present. Exemplary complexing agents include the polysulphates, such as pentasodium tripolyphosphate, tetrasodium pyrophosphate, and sodium hexametaphosphate; isosaccharinic acid, gluconic acid, sodium gluconate, sodium heptonate, lactic acid, dihydroxybutyric acid and aldaric acid; and aminopolycarboxylic acids having the general formula:

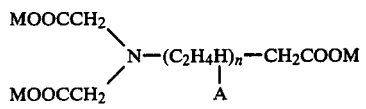

in which A is $CH_2COOH$ or $CH_2CH_2OH$ and n is a number within the range from 0 to 5, and M is hydrogen, an alkali metal or ammonium.

Other suitable chelating acids include ethylene diamine tetraacetic acid, nitrilotriacetic acid and diethylene triaminepentaacetic acid, as well as amines, particularly hydroxy alkyl amines such as mono-, di- and triethanolamine, and diamines, triamines and higher polyamines having complexing properties, as well as heterocyclic amines such as dipicolylamine. Mixtures of these complexing and chelating agents can also be used, especially combinations of chelating agents that contain nitrogen with chelating agents that do not contain nitrogen.

Particularly useful are the metal complexing agents present in waste cellulose bleaching liquors, which should be alkaline. Such liquors as indicated above in conjunction with the bleaching normally contain complexing agents derived from the cellulose, as well as the complexing agents added for the purpose of the cellulose process from which the waste liquor is obtained.

Suitable waste liquors are, for example, waste bleaching liquors, especially those from peroxide bleaching processes.

Reducing chemicals which can be employed in the pretreating solution of the invention include sulfur dioxide, alkali metal bisulfites and bisulfites, and alkali such as sodium or potassium hydroxide, sodium and zinc dithionite, boron hydride, thioglycolic acid, ethanolamine and hydroxylamine.

Figure 1:
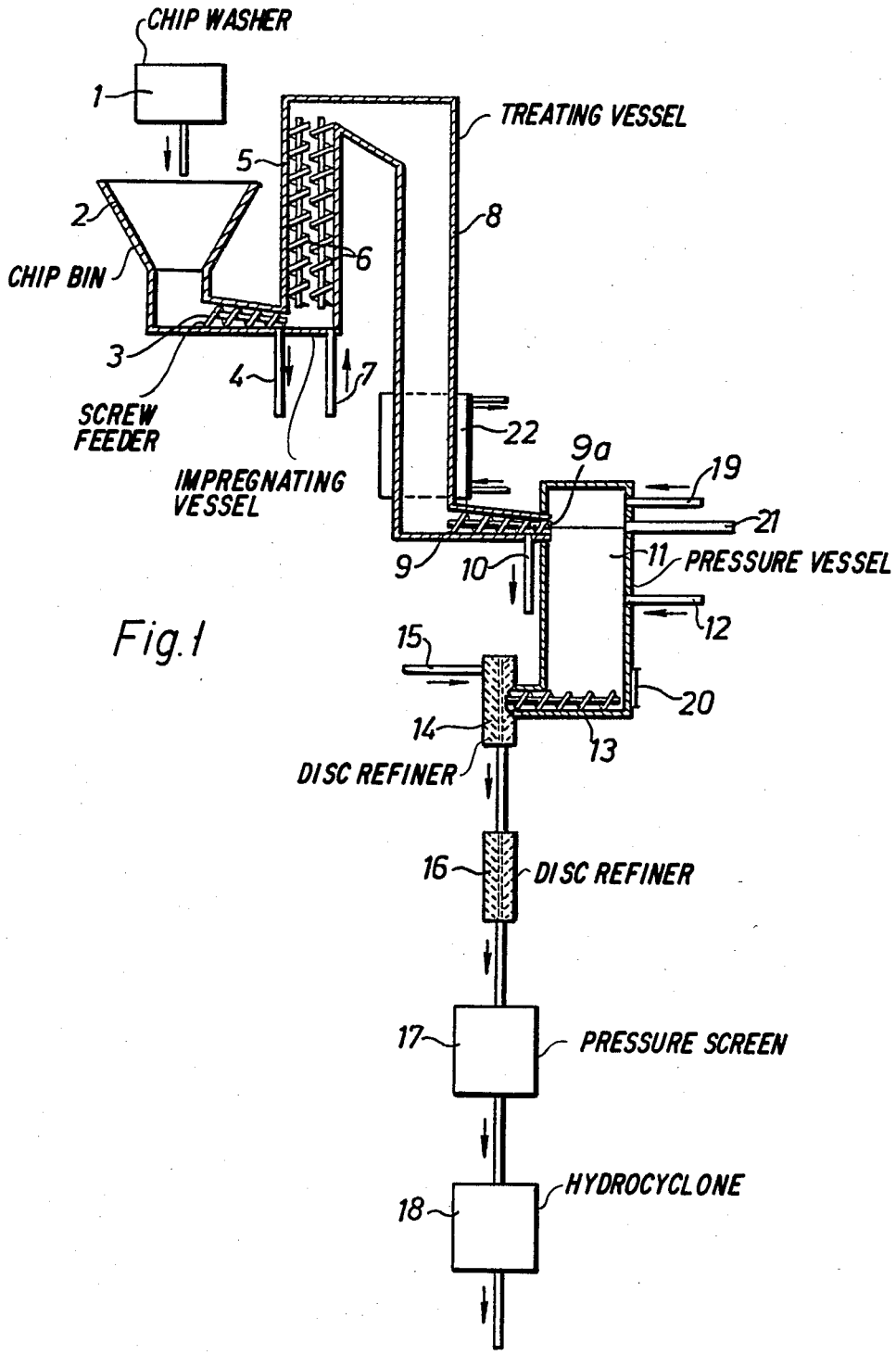
FIG. 1 illustrates in flow sheet form an apparatus suitable for carrying out the process of the invention.
Figure 2:
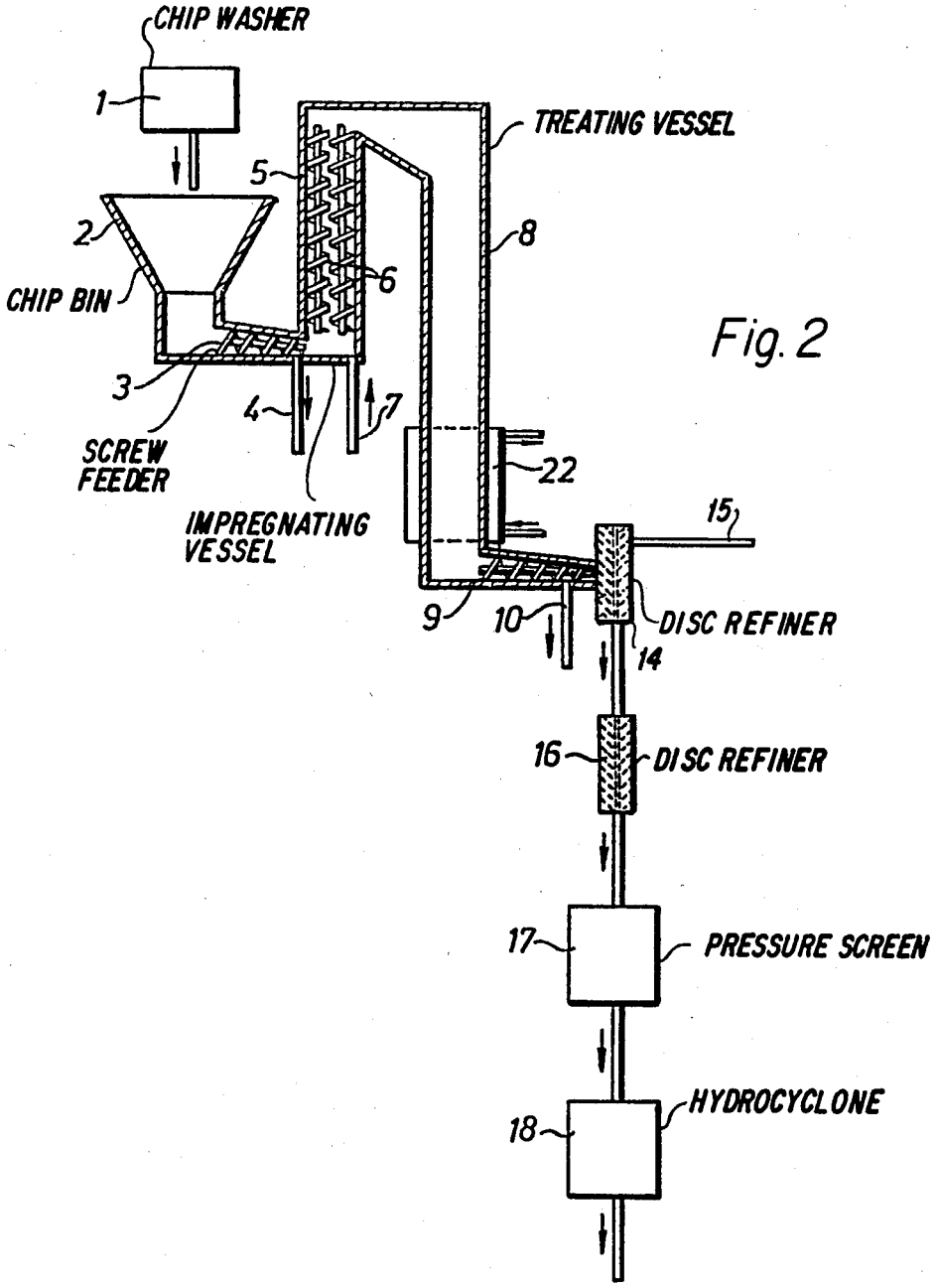
FIG. 2 illustrates in flow sheet form a modified apparatus similar to that of FIG. 1, but with the particulate lignocellulosic material, after compression to a solids content to at least 40%, defibrated directly in the defibrator 14.

In the system shown in FIGS. 1 and 2, the particulate lignocellulosic material such as wood chips is plunged into a chip washer 1, where the chips are washed with water, and then passed to a chip bin 2, the lower end of which opens into a tapered screw feeder 3, which feeds the chips from the bottom of the chip bin to the bottom of the vertical impregnating vessel 5. The screw feeder 3 operates within a housing shell whose walls have a plurality of perforations (not shown) for fluid to escape from within the shell, and narrows in diameter towards the outlet, and thus is similar to a continuously working screw press. During passage of the chips through the screw feeder 3, they are compressed, so that liquid from the washer 1 is expressed, and drained off via the drain pipe 4.

The vertical impregnating vessel 5 has two screws 6 for conveying the chips upwardly through the vessel. The pretreating solution which is instantaneously impregnated into the chips in this vessel is admitted via the duct 7. The solution does not enter the screw feeder 3 because of the bulk of compressed chips, which serves as a sealing plug, while the expressed wash liquid leaves via pipe 4 within the mass of chips before the end of the screw feeder.

After progressing upwardly through the impregnating vessel 5, the impregnated chips enter the top of the vessel 8 and then move downwardly. The rate of their passage through the vessel is adjusted to give the desired treating time. The temperature in the vessel 8 with the aid of a steam jacket 22 can be held at any elevated pretreating temperature within the desired range of from about 50° to about 100° C.

The pretreated chips progressing downwardly through the vessel 8 eventually reach the bottom of the vessel, and enter a second screw conveyor 9 having a tapering outlet. In FIG. 1 the outlet conveys the chips to a pressure vessel 11. The screw conveyor 9 also has a decreasing diameter towards the outlet, so that a sealing plug of chips is formed against the excess pressure in the pressure vessel 11. The feeder 9 is also equipped with a conically shaped ram 9*a* for compressing the chips to increase the density of the material. The ram is put under pressure with the help of the hydraulic cylinder 21. In this way, the pretreating liquor is expressed from the chips during their passage through the feeder 9, and drains out through the duct 10, located just before the end of the feeder. This undiluted liquor contains the materials dissolved in the liquor in the course of the pretreatment, including chemicals, heavy metal compounds and other alkali-soluble extracted organic and inorganic substances in the lignocellulosic material, but no lignin.

The outlet of the screw feeder 9 is connected to the top of the pressure vessel 11, in which the chips can be heated with saturated steam admitted through the duct 12. Compressed air can be admitted via the duct 19, to moderate the steam temperature. The chips progress downwardly through the vessel 11, reaching the screw conveyor 13 at its bottom, which feeds the chips to the center of the grinder housing of a disc refiner 14. The chips are defibrated and refined in the disc refiner 14, so that individual fibers are obtained. Bleaching chemicals are charged to the grinder 14 via duct 15, at a distance from the center of the discs.

In FIG. 2, the outlet from the screw conveyor 9 conveys the chips directly to the disc refiner 14, after which the operation is the same as FIG. 1.

The partially defibrated pulp passes to the second disc refiner 16, where defibration and refining are completed. The pulp obtained is then screened in a pressure screen 17, and cleaned in two steps in a hydrocyclone 18. The finished pulp is then separated from the system.

The following Examples in the opinion of the inventors represent preferred embodiments of the invention.

EXAMPLE 1

In this Example the plant schematically in FIG. 1 was used.

Spruce logs were made into chips, the average length of which was about 25 mm, average width about 20 mm, and average thickness about 3 mm. The chips were washed with water at about 85° C. in the chip washer 1. After the chip washer 1, the chips were conveyed to the chip bin 2, the lower end of which was connected to the screw feeder 3. During the passage of the chips through the screw feeder 3, they were compressed to a solids content of 42% so that excess liquid was pressed out and escaped through the perforations in the wall of the screw feeder, and withdrawn through the pipe 4.

The pretreating solution charged through the duct 7 into the impregnating vessel 5 was an aqueous solution of diethylenetriamine pentaacetic acid, sodium bisulfite and sodium hydroxide. During impregnation of the chips in the impregnating vessel, each kilogram of chips (based on its absolute dry weight) absorbed about 1 liter of this solution, and about 0.3 liter impregnating liquor accompanied the chips on their surfaces. The impregnation was so adjusted that 0.2% DTPA, 1% $NaHSO_3$ and 0.5% NaOH, calculated as 100% pure, and based on the absolutely dry wood weight, was absorbed in the chips.

The impregnated chips then entered the reaction vessel 8, wherein the temperature was kept at about 90° C. with the aid of a steam jacket 22. After a 10 minutes transit time the treated chips reached the second screw conveyor 9, and were compressed to a solids content of 41% and densified such that about 1.3 $m^3$ liquor per ton of chips was pressed out, and led away through the duct 10. The liquor contained alkali-soluble reaction products formed with added chemicals and the organic and inorganic substances in the wood, as well as heavy metal ions bonded in the chelate complex. This is also clearly apparent from the comparison (Table I) below, showing the analyses of spruce wood chips treated according to the invention (Example 1) and chips not treated at all (Control). The expressed liquor had a pH of 7.9, and not even a trace of free sulphur dioxide.

TABLE I

| | Content of metals in spruce wood | |
|---|---|---|
| | Control (untreated) | Example 1 |
| Fe SCAN-C 13:62 (mg/kg) | 120 | 58 |
| Mn SCAN-C 14:62 (mg/kg) | 77 | 32 |

As is apparent, the pretreatment according to the invention gave a considerable reduction of the heavy metal content in the chips. The heavy metal ions remaining in the chips were furthermore complex-bonded.

The pretreated chips were fed into the pressure vessel 11, wherein the chips were heated with saturated steam 12 to 95° C. for 3 minutes. Compressed air through the duct 19 was applied to regulate the temperature. The steamed chips were defibrated and refined in the disc refiner 14 so that individual fibers were obtained. At a distance from the center of the discs corresponding to half their radius, an aqueous bleaching solution was charged via duct 15, containing 3.0% $H_2O_2$, 5% $Na_2SiO_3$ (42° Bé), 0.03% $MgSO_4$, and 1.0% NaOH, based on the weight of dry pulp. Energy consumption for defibration was measured at 0.8 MWh per ton finished pulp.

The pulp was further treated in a second disc refiner 16, and in this stage 0.6 MWh per ton pulp was consumed.

The refined pulp was screened in one step in a pressure screen 17, and in two steps in the hydrocyclone 18. The finished pulp was tested for brightness, metal content and paper characteristics. The results are shown in Table II, below.

For comparison with the above results, as a control thermomechanical pulp was produced without the pretreatment but otherwise in the plant from the same spruce chips of FIG. 1. After the chip washer 1, the chips were passed directly to the reaction vessel 8 by means of the screw feeder 3. No bleaching chemicals were charged at the first defibrating and refining step 14, and only steam 12 was used in the pressure vessel 11 in preheating the chips to 125° C. for 3 minutes. Otherwise, the chips were processed in the same way as above.

The energy consumption and analysis results are shown in Table II.

TABLE II

| | Example 1 | Control |
|---|---|---|
| Energy consumption (MWh/t) | | |
| Step 1 | 0.8 | 1.1 |
| Step 2 | 0.6 | 0.7 |
| Freeness CSF (ml) | 300 | 275 |
| Shives content of unscreened pulp. Sommerville (gap width 0.15 mm) (%) | 0.30 | 0.65 |
| Brightness SCAN-C 1:62 (%) | 76 | 60 |
| Extractives content SCAN-C 7:62 (DKM %) | 0.55 | 1.20 |
| Tensile index (kNm/kg) | 42 | 30 |
| Tearing index ($Nm^2/kg$) | 10.0 | 7.0 |
| Light scattering coefficient ($m^2/kg$) | 58 | 60 |
| Iron (Fe) SCAN-C 13:62 (mg/kg) | 37 | 101 |
| Manganese (Mn) SCAN-C 14:62 (mg/kg) | 18 | 69 |

The energy consumption was reduced by about 22% by the pretreatment of the invention with alkali, bisulphite and complexing agents, as compared with the Control, which represents the conventional production of thermomechanical pulp. The paper characteristics of the pulp were substantially improved.

The effect of pretreatment with a complexing agent is especially apparent in a comparison of the brightness of the pulps. The addition of complexing agent and bleaching chemicals has thus increased brightness by 16 units, in comparison with the Control. Especially surprising is the low extractives content achieved using the process of the invention. The method is thus especially valuable for producing pulps which are to be used for absorbent products, e.g., soft paper and fluffed pulp. After impregnation, the liquid can be recovered in a conventional way, or dissolved-out extracted substances can be regained in the same way as for tall oil extraction.

A further comparison was made to establish that no lignin was removed during the pretreatment of the invention. Samples of the pretreated product after compression in the screw feeder 9 were taken and analyzed for lignin, and compared with the lignin content of the untreated spruce chips, with the following results:

| | Lignin Content (% by Weight of Dry Chips) |
|---|---|
| Untreated | 27.6% |
| Pretreated | 28.1% |

The pretreated product had a weight loss of 3.9%, due to the loss of material by dissolution in the pretreatment. Thus, the total weight of the material was reduced, and when this is taken with account, it is seen that the lignin content after the pretreatment is unchanged, the lignin increase being apparent, but not real.

In this comparison with Example 1, the plant shown schematically in FIG. 1 was used.

Spruce logs were made into chips, the average length of which was about 25 mm, average width about 20 mm, and average thickness about 3 mm. The chips were washed with water at about 85° C. in the chip washer 1. After the chip washer 1, the chips were conveyed to the chip bin 2, the lower end of which was connected to the screw feeder 3. During the passage of the chips through the screw feeder 3, they were compressed so that excess liquid was pressed out and escaped through the perforations in the wall of the screw feeder, and withdrawn through the pipe 4.

The pretreating solution charged through the duct 7 into the impregnating vessel 5 was an aqueous solution of sodium hydroxide. During impregnation of the chips in the impregnating vessel, each kilogram of chips (based on its absolute dry weight) absorbed about 1 liter of this solution, and about 0.3 liter impregnating liquor accompanied the chips on their surfaces. The impregnation was so adjusted that 0.5% NaOH, calculated as 100% pure, and based on the absolutely dry wood weight, was absorbed in the chips.

The impregnated chips then entered the reaction vessel 8, wherein the temperature was kept at about 90° C. with the aid of a steam jacket 22. After a 10 minutes transit time the treated chips reached the second screw conveyor 9 and were compressed and densified such that about 1.3 $m^3$ liquor per ton of chips was pressed out, and led away through the duct 10. The liquor contained alkali soluble reaction products formed with added chemicals and the organic and inorganic substances in the wood, as well as heavy metal ions soluble in alkali and in complexes with acids dissolved from the wood. This is also clearly apparent from the comparison (Table III) below, showing the analyses of spruce wood chips treated according to a modification for comparison with the invention (Control 1) and chips not treated at all (Control 2). The expressed liquor had a pH of 8.2.

TABLE III

| | Contents of metals in spruce wood | |
|---|---|---|
| | Control 1 | Control 2 (untreated) |
| Fe SCAN-C 13:62 (mg/kg) | 92 | 120 |
| Mn SCAN-C 14:62 (mg/kg) | 64 | 77 |

As is apparent, the Control 1 gave a considerable reduction of the heavy metal content in the chips, but not as much as Example 1.

The pretreated chips were fed into the pressure vessel 11, wherein the chips were heated with saturated steam 12 to 95° C. for 3 minutes. Compressed air through the duct 19 was applied to regulate the temperature. The steamed chips were defibrated and refined in the disc refiner 14 so that individual fibers were obtained. At a distance from the center of the discs corresponding to half their radius, an aqueous bleaching solution was charged via duct 15, containing 3.0% $H_2O_2$, 5% $Na_2SiO_3$ (42° Bé), 0.03% $MgSO_4$, and 1.0% NaOH, based on the weight of dry pulp. Energy consumption for defibration was measured at 0.9 MWh per ton finished pulp.

The pulp was further treated in a second disc refiner 16, and in this stage 0.7 MWh per ton pulp was consumed.

The refined pulp was screened in one step in a pressure screen 17, and in two steps in the hydrocyclone 18. The finished pulp was tested for brightness, metal content and paper characteristics. The results are shown in Table IV, below, under Control 1.

For comparison with the above results, as Control 2A thermomechanical pulp was produced without the pretreatment but otherwise in the plant from the same spruce chips of FIG. 1. After the chip washer 1, the chips were passed directly to the reaction vessel 8 by means of the screw feeder 3. No bleaching chemicals were charged at the first defibrating and refining step 14, and only steam 12 was used in the pressure vessel 11 in heating the chips to 125° C. for 3 minutes. Otherwise, the chips were processed in the same way as above.

The energy consumption and analysis results are shown in Table IV:

TABLE IV

| | Control 1 | Control 2A |
|---|---|---|
| Energy consumption (MWh/t) | | |
| Step 1 | 0.9 | 1.1 |
| Step 2 | 0.7 | 0.7 |
| Freeness CSF (ml) | 305 | 275 |
| Shives content of unscreened pulp. Sommerville (gap width 0.15 mm) (%) | 0.43 | 0.65 |
| Brightness SCAN-C 1:62 (%) | 72 | 60 |
| Extractives content SCAN-C 7:62 (DKM %) | 0.68 | 1.20 |
| Tensile index (kNm/kg) | 39 | 30 |
| Tearing index ($Nm^2$/kg) | 9.5 | 7.0 |
| Light scattering coefficient ($m^2$/kg) | 59 | 60 |
| Iron (Fe) SCAN-C 13:62 (mg/kg) | 89 | 101 |
| Manganese (Mn) SCAN-C 14:62 (mg/kg) | 61 | 69 |

The energy consumption was reduced by about 11% by the pretreatment of Control 1 with alkali as compared with Control 2A, which represents the conventional production of thermomechanical pulp. The paper characteristics of the pulp were substantially improved.

The effect of pretreatment in combination with bleaching is especially apparent in a comparison of the brightness of the pulps. The extraction with alkali and bleaching has increased brightness by 12 units, in comparison with Control 2A, but this is still not as good as Example 1. Expecially surprising is the low extractives content achieved using the process of the invention, Example 1, as compared to Control 1. The method is thus especially valuable for producing pulps which are to be used for absorbent products, e.g., soft paper and fluffed pulp. After impregnation, the liquid can be recovered in a conventional way, or dissolved-out extracted substances can be regained in the same way as for tall oil extraction.

In this comparison with Example 1 the plant shown schematically in FIG. 1 was used.

Spruce logs were made into chips, the average length of which was about 25 mm, average width about 20 mm, and average thickness about 3 mm. The chips were washed with water at about 85° C. in the chip washer 1. After the chip washer 1, the chips were conveyed to the chip bin 2, the lower end of which was connected to the screw feeder 3. During the passage of the chips through the screw feeder 3, they were compressed so that excess liquid was pressed out and escaped through the perforations in the wall of the screw feeder, and withdrawn through the pipe 4.

The pretreating solution charged through the duct 7 into the impregnating vessel 5 was an aqueous solution of sodium bisulfite and sodium hydroxide. During impregnation of the chips in the impregnating vessel, each kilogram of chips (based on its absolute dry weight) absorbed about 1 liter of this solution, and about 0.3 liter impregnating liquor accompanied the chips on their surfaces. The impregnation was so adjusted that 1% $NaHSO_3$ and 0.5% NaOH, calculated as 100% pure, and based on the absolutely dry wood weight, was absorbed in the chips.

The impregnated chips then entered the reaction vessel 8, wherein the temperature was kept at about 90° C. with the aid of a steam jacket 22. After a 10 minutes transit time the treated chips reached the second screw conveyor 9, and were compressed and densified such that about 1.3 $m^3$ liquor per ton of chips was pressed out, and led away through the duct 10. The liquor contained alkali-soluble reaction products formed with added chemicals and the organic and inorganic substances in the wood, as well as heavy metal ions soluble in alkali and in complexes with acids derived from the wood. This is also clearly apparent from the comparison (Table V) below, showing the analyses of spruce wood chips treated according to Control 3 and chips not treated at all (Control 4). The expressed liquor had a pH of 7.6, and not even a trace of free sulphur dioxide.

TABLE V

| | Content of metals in spruce wood | |
|---|---|---|
| | Control 3 | Control 4 (untreated) |
| Fe SCAN-C 13:62 (mg/kg) | 68 | 120 |
| Mn SCAN-C 14:62 (mg/kg) | 51 | 77 |

As is apparent, the pretreatment according to Control 3 gave a considerable reduction of the heavy metal content in the chips, but not as good as in Example 1.

The pretreated chips were fed into the pressure vessel 11, wherein the chips were heated with saturated steam 12 to 95° C. for three minutes. Compressed air through the duct 19 was applied to regulate the temperature.

The steamed chips were defibrated and refined in the disc refiner 14 so that individual fibers were obtained. At a distance from the center of the discs corresponding to half their radius, an aqueous bleaching solution was charged via duct 15, containing 3.0% $H_2O_2$, 5% $Na_2SiO_3$ (42° Bé), 0.03% $MgSO_4$, and 1.0% NaOH, based on the weight of dry pulp. Energy consumption for defibration was measured at 0.8 MWh per ton finished pulp.

The pulp was further treated in a second disc refiner 16, and in this stage 0.6 MWh per ton pulp was consumed.

The refined pulp was screened in one step in a pressure screen 17, and in two steps in the hydrocyclone 18. The finished pulp was tested for brightness, metal content and paper characteristics. The results are shown in Table VI, below, under Control 3.

For comparison with the above results, as Control 4A thermomechanical pulp was produced without the pretreatment but otherwise in the plant from the same spruce chips of FIG. 1. After the chip washer 1, the chips were passed directly to the reaction vessel 8 by means of the screw feeder 3. No bleaching chemicals were charged at the first defibrating and refining step 14, and only steam 12 was used in the pressure vessel 11 in heating the chips to 125° C. for 3 minutes. Otherwise, the chips were processed in the same way as above.

The energy consumption and analysis results are shown in Table VI.

TABLE VI

| | Control 3 | Control 4A |
|---|---|---|
| Energy consumption (MWh/t) | | |
| Step 1 | 0.8 | 1.1 |
| Step 2 | 0.6 | 0.7 |
| Freeness CSF (ml) | 290 | 275 |
| Shives content of unscreened pulp. Sommerville (gap width 0.15 mm) (%) | 0.30 | 0.65 |
| Brightness SCAN-C 1:62 (%) | 73 | 60 |
| Extractives content SCAN-C 7:62 (DKM %) | 0.60 | 1.20 |
| Tensile index (kNm/kg) | 41 | 30 |
| Tearing index ($Nm^2/kg$) | 9.8 | 7.0 |
| Light scattering coefficient ($m^2/kg$) | 59 | 60 |
| Iron (Fe) SCAN-C 13:62 (mg/kg) | 56 | 101 |
| Manganese (Mn) SCAN-C 14:62 (mg/kg) | 43 | 69 |

The energy consumption was reduced by about 22% by the pretreatment of Control 3 with alkali and bisulphite as compared with Control 4A which represents the conventional production of thermomechanical pulp, but the results were still not as good as Example 1. The paper characteristics of the pulp were substantially improved.

The effect of pretreatment in combination with bleaching is especially apparent in a comparison of the brightness of the pulps. The addition of alkali, bisulfite and bleaching chemicals has increased brightness by thirteen units in Control 3, in comparison with Control 4A. Especially surprising is the low extractives content achieved using the process of the invention in Example 1, in comparison with Controls 3 and 4A. The method is thus especially valuable for producing pulps which are to be used for absorbent products, e.g., soft paper and fluffed pulp. After impregnation, the liquid can be recovered in a conventional way, or dissolved-out extractive substances can be regained in the same way as for tall oil extraction.

EXAMPLE 2

In this Example the plant shown schematically in FIG. 1 was used.

Spruce logs were made into chips, the average length of which was about 25 mm, average width about 20 mm, and average thickness about 3 mm. The chips were washed with water at about 85° C. in the chip washer 1. After the chip washer 1, the chips were conveyed to the chip bin 2, the lower end of which was connected to the screw feeder 3. During the passage of the chips through the screw feeder 3, they were compressed so that excess liquid was pressed out and escaped through the perforations in the wall of the screw feeder, and withdrawn through the pipe 4.

The pretreating solution charged through the duct 7 into the impregnating vessel 5 was an aqueous solution of DTPA, sodium bisulfite and sodium hydroxide. During impregnation of the chips in the impregnating vessel, each kilogram of chips (based on its absolute dry weight) absorbed about 1 liter of this solution, and about 0.3 liter impregnating liquor accompanied the chips on their surfaces. The impregnation was so adjusted that 0.2% DTPA, 1% $NaHSO_3$ and 0.5% NaOH, calculated as 100% pure, and based on the absolutely dry wood weight, was absorbed in the chips.

The impregnated chips then entered the reaction vessel 8, wherein the temperature was kept at about 90° C. with the aid of a steam jacket 22. After a 10 minute transit time the treated chips reached the second screw conveyor 9, and were compressed and densified such that about 1.3 $m^3$ liquor per ton of chips was pressed out, and led away through the duct 10. The liquor contained alkali-soluble reaction products formed with added chemicals and the organic and inorganic substances in the wood, as well as heavy metal ions bonded in the chelate complexes. This is also clearly apparent from the comparison (Table VII) below, showing the analysis of spruce wood chips treated according to the invention (Example 2) and chips not treated at all (Control). The expressed liquor had a pH of 7.9, and not even a trace of free sulphur dioxide.

TABLE VII

| | Content of metals in spruce wood | |
|---|---|---|
| | Control (untreated) | Example 2 |
| Fe SCAN-C 13:62 (mg/kg) | 120 | 57 |
| Mn SCAN-C 14:62 (mg/kg) | 77 | 34 |

As is apparent, the pretreatment according to the invention gave a considerable reduction of the heavy metal content in the chips. The heavy metal ions remaining in the chips were furthermore complex-bonded.

The pretreated chips were fed into the pressure vessel 11, wherein the chips were heated with saturated steam 12° to 95° C. for 3 minutes. Compressed air through the duct 19 was applied to regulate the temperature. The steamed chips were defibrated and refined in the disc refiner 14 so that individual fibers were obtained. At a distance from the center of the discs corresponding to half their radius, an aqueous bleaching solution was charged via duct 15, containing 3.0% $H_2O_2$, 5% $Na_2SiO_3$ (42° Bé), 0.03% $MgSO_4$, and 1.0% NaOH, based on the weight of dry pulp. Energy consumption for defibration was measured at 0.8 MWh per ton finished pulp.

The pulp was further treated in a second disc refiner 16, and in this stage 0.6 MWh per ton pulp was consumed.

The refined pulp was screened in one step in a pressure screen 17, and in two steps in the hydrocyclone 18. The finished pulp was tested for brightness, metal content and paper characteristics. The results are shown in Table VIII, below.

For comparison with the above results, as a control thermomechanical pulp was produced without the pretreatment but otherwise in the plant from the same spruce chips of FIG. 1. After the chip washer 1, the chips were passed directly to the reaction vessel 8 by means of the screw feeder 3. No bleaching chemicals were charged at the first defibrating and refining step 14, and only steam 12 was used in the pressure vessel 11 in heating the chips to 125° C. for 3 minutes. The pulp was further treated in a second disc refiner 16, but in this stage an aqueous bleaching solution was charged containing 3.0% $H_2O_2$, 5% $Na_2SiO_3$ (42° Bé), 0.03% $MgSO_4$, 1.0% NaOH and 0.2% DTPA. Energy consumption in the two defibration stages was 0.9 MWh and 0.7 MWh respectively per ton pulp. Otherwise, the chips were processed in the same way as above.

The energy consumption and analysis results are shown in Table VIII.

TABLE VIII

| | Example 2 | Control (refiner-bleached) |
|---|---|---|
| Energy consumption (MWh/t) | | |
| Step 1 | 0.8 | 0.9 |
| Step 2 | 0.6 | 0.7 |
| Freeness CSF (ml) | 300 | 310 |
| Shives content of unscreened pulp. | 0.30 | 0.45 |
| Sommerville (gap width 0.15 mm) (%) | | |
| Brightness SCAN-C 1:62 (%) | 76 | 71 |
| Extractives content SCAN-C 7:62 (DKM %) | 0.52 | 0.83 |
| Tensile index (kNm/kg) | 42 | 37 |
| Tearing index ($Nm^2/kg$) | 10.0 | 9.2 |
| Light scattering coefficient ($m^2/kg$) | 58 | 59 |
| Iron (Fe) SCAN-C 13:62 (mg/kg) | 35 | 62 |
| Manganese (Mn) SCAN-C 14:62 (mg/kg) | 16 | 49 |

The energy consumption was reduced by 12.5% by the pretreatment of the invention as compared with the Control, which represents the conventional production of refiner-bleached thermomechanical pulp. The paper characteristics of the pulp were substantially improved.

The pulp produced according to the present invention is thus considerably stronger, and above all, considerably brighter, than the Control, refiner bleached thermomechanical pulp. It is thus not solely the addition of bleaching chemicals in the first defibrating and refining step that is responsible for the strong and bright pulp of the invention.

No certain explanation of the surprising result can be supplied at present. Possibly however the chips during their passage through the two screw feeders are subjected to some kind of predefibration which results in a stronger pulp. The addition of reducing agents and complexing agent, combined with compression, may reduce the decomposition of the peroxide, which in turn contributes to the high brightness of the pulp.

EXAMPLE 3

Spruce sulphite pulp of the dissolving type was produced according to the prior art, without pretreatment, and also according to the process of the invention. The chips were taken from the plant shown in FIG. 1, the control nonpretreated batch being wood just reduced to chips, while the batch of the invention had been treated with the alkaline liquor of complexing agents, alkali and bisulphite, according to Example 1, and was taken out through a hatch 20 on the pressure vessel 11. The steam supply 12 to the pressure vessel 11 was interrupted, to take out the treated chips. Each bach was 3 kg chips based on dry weight.

The two batches were then subjected to sulphite digestion in a laboratory digester having a volume of 25 liters. The untreated control batch was digested first, and then the batch which had been pretreated according to the invention.

Both batches were digested in the liquid phase, under the following conditions:

Ratio of liquid (wood moisture included) to dry wood=4.5:1

The digestion liquor provided a charge of 4.0% $Na_2O$ and 24.0% $SO_2$, calculated by weight of absolutely dry wood.

Before the addition of the digestion liquor in each batch, the chips were treated with saturated steam at atmospheric pressure for 30 minutes.

Chips and cooking liquor were heated by circulating the cooking liquor through a heat exchanger. The content of the digester was heated in this way to 95° C. for a period of 45 minutes, and then at from 95° C. to 110° C. for a further 3 hours, after which the temperature was increased to 145° C. for a period of 60 minutes. The chips were subsequently digested at 145° C. for 3 hours, whereon the excess pressure in the digester was gradually reduced to atmospheric pressure during a period of 20 minutes.

The digested chips were screened in a laboratory screen of the Wennberg type, with a slot size of 0.25 mm, whereon the screened pulp was dewatered in a centrifuge to a dry content of about 30%, and was torn to small pieces before drying at 35° C. for 16 hours. The pulp yield and other characteristics of the pulps from each batch are shown below.

TABLE IX

| | Control | Example 3 |
|---|---|---|
| Pulp yield (%) | 46.2 | 47.3 |
| Shives content (%) | 0.83 | 0.36 |
| Kappa number SCAN-C 1:59 | 6.7 | 5.8 |
| Extractives content SCAN-C 7:62 (DKM %) | 1.33 | 0.61 |
| Viscosity SCAN-C 15:62 (Tappi cP) | 41.8 | 56.5 |
| Fe SCAN-C 13:62 (mg/kg) | 14 | 12 |
| Mn SCAN-C 14:62 (mg/kg) | 8 | 5 |

As is apparent from the results above, the batch according to the invention gave a pulp with substantially lower extractives content and somewhat lower content of heavy metal ions. Surprisingly enough, the batch according to the invention also gave a higher pulp yield and lower shives content than the control batch for a comparable Kappa number. Possibly in the pretreatment with alkali, inter alia, sodium ions are introduced into the chips, which have a positive effect during digestion. Another explanation may be that a glucomannan stabilization is obtained during the pretreatment of the chips, which has contributed to increasing the pulp yield. A third possible explanation is that the chips have been exposed to mechanical working during the passage through the screw feeders, resulting in crack formation and points of stress concentration, which during subsequent digestion facilitated the digesting liquor penetration into the pieces of chips, and thereby resulted in a more homogeneous sulphonization than that which can be obtained in digestion of chips which have not been pretreated.

For comparison with Example 3, control runs with pretreatments according to the Samuelson et al U.S. Pat. Nos. 3,701,712 and 3,769,152 and Jamieson et al U.S. Pat. No. 4,050,981 were carried out.

Spruce sulphite pulps of the dissolving type were produced according to these patents using their particularly suitable and preferred pretreatment processes.

About 6 kg of spruce chips, calculated as oven dry, were taken from the plant shown in FIG. 1, the 6 kg batch being wood just reduced to chips. The whole batch of chips was then filled into a pressure vessel having a volume of about 40 liters. To the vessel was further charged 25 liters of a hot (70° C.) aqueous solution of sodium bisulfite and DTPA. The solution contained 30 g/l of $NaHSO_3$ and 2 g/l of DTPA chelating agent. After closing the vessel nitrogen gas was added until a pressure of 1 MPa was obtained inside the vessel. In order to achieve a good liquor flow and good contact between the chips and the pretreating solution, the solution was pumped from the bottom of the vessel and fed into the top of the vessel during the entire period of treatment, which lasted 60 minutes.

A third, about 2 kg, of the pretreated batch of chips (designated Control 1) was then immediately subjected to sulphite digestion in a laboratory digester having a volume of 25 liters. The digestion was performed in liquid phase, under the following conditions:

$$\text{Ratio}\ \frac{\text{liquid, including wood moisture}}{\text{dry wood}} = \frac{4.5}{1}$$

The digestion liquor contained 4.0% $Na_2O$ and 24.0% $SO_2$, calculated by weight of absolutely dry wood.

Before adding the digestion liquor to the digester, the chips were treated with saturated steam at atmospheric pressure for 30 minutes.

The batch of spruce chips (Control 1) and the cooking liquor were heated by circulating the liquor through a heat exchanger. The content of the digester was heated in this way to 95° C. for a period of 45 minutes, and then at from 95° C. to 110° C. for a further 3 hours, after which the temperature was increased to 145° C. for a period of 60 minutes. The chips were subsequently digested at 145° C. for 3 hours, whereon the excess pressure in the digester was gradually reduced to atmospheric pressure during a period of 20 minutes.

The digested chips were screened in a laboratory screen of the Wennberg type with slot size of 0.25 mm, whereon the screened pulp was dewatered in a centrifuge to a dry content of about 30%, and was torn to small pieces before drying at 35° C. for 16 hours. The pulp yield and other characteristics of the Control 1 pulp are shown in Table X below.

Another third (2 kg) of the pretreated batch of spruce chips, designated Control 2, was washed with tap water for 3 hours. The volume of clean tap water used for the washing amounted to 1800 liters, i.e., about 900 liters per kg of dry wood washed. In spite of the considerable amount of water used, traces of DTPA could still be found in the pretreated chips, which may be explained by the dense structure of the chips and the fact that the DTPA molecule is comparatively large.

The washed chips of Control 2 were then subjected to sulphite digestion, screening, dewatering and drying in a manner similar to that used for the Control 1 chips.

The last third of the pretreated batch of spruce chips, 2 kg, designated Control 3, was washed in the same way as Control 2, with the exception that the water used was not tap water, but deionized clean water. Traces of DTPA could, however, also here be found subsequent to the extremely vigorous washing with deionized water. Also the chips of Control 3 were then digested, screened, dewatered and dried in exactly the same manner as the chips of Controls 1 and 2. Yield and other characteristics of Controls 2 and 3 pulps are shown in Table X below. For comparison, the characteristics of the Example 5 pulp—which was pretreated according to the process of the invention, but digested, screened, dewatered and dried in a manner similar to that used for the controls—are also shown in Table X.

TABLE X

| | Control 1 | Control 2 | Control 3 | Example 3 |
|---|---|---|---|---|
| Pulp yield (%) | 47.3 | 46.4 | 46.1 | 47.3 |
| Shives content (%) | 0.88 | 0.80 | 0.91 | 0.36 |
| Kappa number, SCAN-C 1:59 | 6.1 | 6.8 | 6.5 | 5.8 |
| Extractives content (DKM %) SCAN-C 7:62 | 0.79 | 0.96 | 0.77 | 0.61 |
| Viscosity, SCAN-C 15:62 (TAPPI cP) | 48.0 | 40.2 | 50.0 | 56.5 |
| Fe, SCAN-C 13:62 (mg/kg) | 14 | 18 | 12 | 12 |
| Mn, SCAN-C 14:62 (mg/kg) | 8 | 9 | 6 | 5 |

As is evident from the results above, the pulp pretreated according to the process of the invention had a substantially lower shives content and in addition a lower extractives content and a considerably higher viscosity than the controls.

The fact that the Control 2 pulp had such a high content of metals indicates that possibly the chips may have functioned as an ion exchanger, and absorbed heavy metal ions from the wash water. Furthermore, the fact that Control 3, in spite of the exceedingly expensive washing with deionized water, resulted in an inferior pulp compared with Example 3 is surprising, and results in all probability from the absence of compression in two stages before and after the pretreatment. This is probably also the case with the pulps of Controls 1 and 2.

The process of the invention utilizes compression of the lignocellulosic material before and after the impregnation in the pretreating process of the invention. Compression is not disclosed in the Samuelson et al and Jamieson et al references. The data show that the compression steps undoubtedly give useful and unexpected results. The process of the invention may thus be characterized by compressing the lignocellulosic material, i.e., the wood chips, before and after impregnation to a solids content of between 40 and 70%, preferably of between 45 and 55%, the compression being carried out to such an extent that the material subsequent to said compression is capable of instantaneously absorbing a volume of liquid corresponding at least to 80% of the dry weight of the wood.

The process of the invention can thus be used to advantage for producing chemical pulp as well. In this connection it is not always necessary to wash the chips before the impregnation. It can be sufficient to steam the chips and thereafter take them to the screw feeder 3, which is connected to the impregnating vessel 5. For continuous digestion, the impregnating liquid containing complex-bonded heavy metals can be substantially removed by compression in the digester screw feeder 9.

In producing high-yield pulp according to the invention, complexing agents can also be supplied to the process at other places, e.g. in the refiner 14. Furthermore, the temperature is not limited to what is stated for the executed trial. The temperature can thus vary between 50° C. and 100° C. Compressed air can be used to advantage for regulating the temperature, in accordance with Swedish Pat. No. 318,178.

Neither is the invention limited to the addition of bleaching chemicals in the first defibrating and refining step for the production of high-yield pulps. Bleaching chemicals can thus very well be added in a later refining step also.

Bleaching can furthermore be carried out in a separate step, the residue chemicals being recycled to the first defibrating step according to the Swedish Pat. No. 363,650.

Having regard to the foregoing disclosure, the following is claimed as inventive and patentable embodiments thereof:

1. A process for pretreating particulate lignocellulosic material to remove heavy metals and resin without any delignification or defibration, which comprises washing particulate lignocellulosic material; compressing the washed material to a solids content of at least 40% to remove undiluted, absorbed liquid; impregnating the compressed material with an alkaline aqueous solution comprising alkali and at least one member selected from the group consisting of a heavy metal ion complexing agent and a heavy metal ion reducing agent; heating the impregnating material at a temperature within the range from about 50° to 100° C. for from about 0.1 to about 0.75 hour; compressing the pretreated material to a solids content of at least 40%; and separating undiluted liquor squeezed out during the compression; while maintaining conditions during the pretreating such that the pH of the squeezed-out liquor is within the range from about 4 to about 9.5; thereby separating heavy metal ions, resins and alkali-extracted substances in solution in the expressed liquor but no lignin.

2. A process according to claim 1, in which following the pretreatment the particulate lignocellulosic material is delignified and pulped by a chemical pulping process.

3. A process according to claim 2 in which the lignocellulosic material after compression to a solids content of at least 40% is chemically pulped using a chemical pulping process and an aqueous pulping liquor selected from the group consisting of acidic sulfite liquor, bisulfite liquor, sulfite liquor, alkaline sodium hydroxide liquor, alkaline sodium carbonate liquor, alkaline sodium bicarbonate liquor, white liquor, and sodium hydroxide/oxygen gas.

4. A process according to claim 1, in which following the pretreatment the particulate lignocellulosic material is defibrated and refined by a mechanical defibrating process.

5. A process according to claim 1, in which following the pretreatment the particulate lignocellulosic material is delignified, pulped and defibrated by a combined chemical and mechanical delignifying, pulping and defibrating process.

6. A process according to claim 1, in which the amount of alkali in the pretreating solution is so controlled that the pH of the expressed and separated pretreating liquor at the conclusion of the pretreatment is within the range from about 5 to about 7.5.

7. A process according to claim 1, in which the amount of complexing agent in the pretreating solution is within the range from 0.05% to about 0.80%, based on the dry weight of the particulate lignocellulosic material.

8. A process according to claim 1, in which the heavy metal ion reducing agent is selected from the group consisting of sulfur dioxide, sulfurous acid and sulfite salts, and the amount of reducing agent is within the range from about 0.1% to about 3.0%, based on the dry weight of the particulate lignocellulosic material.

9. A process according to claim 1 in which after compression to a solids content of at least about 40% the lignocellulosic material is pulped by heating in a pressure vessel in the presence of at least one of steam and compressed air at a temperature within the range from about 90° to about 180° C. for from about 1 to about 15 minutes, and is then subjected to mechanical defibration.

10. A process according to claim 1 in which the particulate lignocellulosic material after compression to a solids content of at least 40% is defibrated directly.

11. A process according to claim 1 in which after compression to a solids content of at least about 40% the lignocellulosic material is digested and thereby partially chemically pulped by heating in a pressure vessel in the presence of at least one of steam and compressed air at a temperature within the range from about 90° to about 180° C. for from about 1 to about 15 minutes, and is then subjected to mechanical defibration in a disc refiner, in the presence of a bleaching agent supplied to the disc refiner so that it is mixed with the lignocellulosic material in the vicinity of the circumference of the grinding disc, and at a distance of at least one third of the disc radius from its center.

12. A process according to claim 11, in which the bleaching agent is a lignin preserving bleaching agent.

13. A process according to claim 12, in which the bleaching agent is a mixture of a peroxide bleaching agent, sodium hydroxide, sodium silicate and magnesium sulfate.

14. A process according to claim 13, in which the sodium silicate is applied separately at the circumference of the grinding discs or at a distance of at most 200 mm from their circumference, and the remaining bleaching agent is applied at the center of the grinding discs, or at a distance from the center corresponding to at most one quarter of the grinding disc radius.

15. A process according to claim 1 in which the heavy metal ion reducing agent is $SO_2$, and all of the $SO_2$ supplied via the alkaline aqueous solution is consumed so that the expressed liquor contains substantially no free $SO_2$.

16. A process according to claim 1, in which the alkaline aqueous solution comprises alkali.

17. A process according to claim 1, in which the alkaline aqueous solution comprises alkali and a heavy metal ion complexing agent.

18. A process according to claim 1, in which the alkaline aqueous solution comprises alkali and a heavy metal ion reducing agent.

19. A process according to claim 1, in which the alkaline aqueous solution comprises alkali, a heavy metal ion complexing agent, and a heavy metal ion reducing agent.

* * * * *